US012071742B2

(12) United States Patent
Benevelli et al.

(10) Patent No.: US 12,071,742 B2
(45) Date of Patent: Aug. 27, 2024

(54) SYSTEM AND METHOD FOR AUTOMATICALLY GUIDING A MOTOR GRADER WITHIN A WORKSITE

(71) Applicant: CNH Industrial America LLC, New Holland, PA (US)

(72) Inventors: Alessandro Benevelli, Reggio Nell'Emilia (IT); Alessio Aresta, Brindisi Mesagne (IT); Scott A. Elkins, Homer Glen, IL (US)

(73) Assignee: CNH Industrial America LLC, New Holland, PA (US)

( * ) Notice: Subject to any disclaimer, the term of this patent is extended or adjusted under 35 U.S.C. 154(b) by 365 days.

(21) Appl. No.: 17/495,326

(22) Filed: Oct. 6, 2021

(65) Prior Publication Data

US 2023/0105281 A1 Apr. 6, 2023

(51) Int. Cl.

| | |
|---|---|
| ***E02F 3/84*** | (2006.01) |
| ***E02F 9/20*** | (2006.01) |
| ***E02F 9/26*** | (2006.01) |

(52) U.S. Cl.

CPC ..... *E02F 3/842* (2013.01); *E02F 3/844* (2013.01); *E02F 9/205* (2013.01); *E02F 9/2087* (2013.01); *E02F 9/262* (2013.01); *E02F 9/265* (2013.01)

(58) Field of Classification Search

None

See application file for complete search history.

(56) References Cited

U.S. PATENT DOCUMENTS

| | | | | |
|---|---|---|---|---|
| 6,655,465 | B2 * | 12/2003 | Carlson | E02F 9/26 701/472 |
| 7,178,606 | B2 | 2/2007 | Pecchio | |
| 7,676,967 | B2 | 3/2010 | Gharsalli et al. | |
| 8,090,508 | B2 | 1/2012 | Beese | |
| 2006/0042804 | A1 | 3/2006 | Pecchio | |
| 2011/0035109 | A1 * | 2/2011 | Ryerson | B62D 53/045 701/42 |
| 2012/0160526 | A1 * | 6/2012 | Padilla | E02F 3/7645 172/4.5 |
| 2013/0192919 | A1 * | 8/2013 | Subrt | B62D 6/002 180/400 |
| 2013/0255977 | A1 * | 10/2013 | Braunstein | E02F 3/765 701/41 |

(Continued)

*Primary Examiner* — Christian Chace
*Assistant Examiner* — Shayne M. Gilbertson
(74) *Attorney, Agent, or Firm* — Rickard K. DeMille; Rebecca L. Henkel; Peter K. Zacharias

(57) ABSTRACT

A method for automatically guiding a motor grader includes receiving a desired final grade for a worksite and generating a steering path for steering the motor grader across the worksite and moldboard control instructions for actuating a moldboard of the motor grader as the motor grader moves across the worksite based at least in part on the desired final grade, at least one steering performance metric of a steering system of the motor grader, and at least one moldboard performance metric of a moldboard system of the motor grader. Moreover, the method includes receiving an input indicative of a ground speed of the motor grader. Additionally, the method includes controlling the steering system according to the steering path and the moldboard system according to the moldboard control instructions when the ground speed is within a threshold speed range.

18 Claims, 10 Drawing Sheets

(56) References Cited

U.S. PATENT DOCUMENTS

| | | | | |
|---|---|---|---|---|
| 2020/0173135 | A1* | 6/2020 | Gentle | E02F 3/7627 |
| 2022/0333339 | A1* | 10/2022 | Kean | G06T 7/248 |
| 2022/0396928 | A1* | 12/2022 | Gentle | E02F 9/265 |

* cited by examiner

SYSTEM AND METHOD FOR AUTOMATICALLY GUIDING A MOTOR GRADER WITHIN A WORKSITE

FIELD OF THE INVENTION

The present disclosure relates generally to motor graders and, more particularly, to systems and methods for automatically guiding a motor grader within a worksite.

BACKGROUND OF THE INVENTION

Motor graders are used in many aspects of road construction and maintenance, as well as for material moving and finish grading. Motor graders can be used to shape the ground for general purposes, such as developing ditches, and for shaping the final surface of a roadbed. In maintenance operations, motor graders can be used, for example, to clean and reform ditches, to reshape and contour worn roadbeds, to spread added material on a roadbed, to remove snow and the like. To achieve such versatility in operation, motor graders are highly controllable with respect to the set up and operation thereof.

A motor grader can include an articulating frame having a rear frame portion carrying an engine, transmission, operator's cab and the like, and an elongated front frame portion that includes front wheels that can rotate and lean and an earth scraping blade which commonly is referred to as a moldboard. Carrying and adjustment structure for the moldboard allows adjustments for angle, tilt and roll of the moldboard as well as lateral side-shifting.

Manual controls or input devices are typically provided for various operating and adjustment aspects of a motor grader, such as steering, speed, moldboard positioning, frame articulation, wheel angle orientation and power input. For instance, conventional motor graders typically include a mechanical control lever arrangement for controlling the hydraulic functions of the motor grader, with each control lever being mechanically coupled to a corresponding valve (e.g., via a pivot joint(s) and/or linkage rod(s)) of the hydraulic system. However, it is difficult for an operator to control all aspects of the motor grader at once. As such, large inefficiencies may occur over the course of a worksite grading operation.

Accordingly, a system and method for automatically guiding a motor grader within a worksite would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for automatically guiding a motor grader within a worksite. The method includes receiving, with a computing system, a desired final grade for the worksite. The method further includes generating, with the computing system, a steering path for steering the motor grader across the worksite and moldboard control instructions for actuating a moldboard of the motor grader as the motor grader moves across the worksite based at least in part on the desired final grade, at least one steering performance metric of a steering system of the motor grader, and at least one moldboard performance metric of a moldboard system of the motor grader. Moreover, the method includes receiving, with the computing system, an input indicative of a ground speed of the motor grader. Additionally, the method includes controlling, with the computing system, the steering system according to the steering path and the moldboard system according to the moldboard control instructions when the ground speed of the motor grader is within a threshold speed range for the steering path and the moldboard control instructions.

In another aspect, the present subject matter is directed to a system for automatically guiding a motor grader within a worksite. The system includes a steering system of the motor grader, a moldboard system of the motor grader, the moldboard system having an actuatable moldboard, and the system additionally including a computing system communicatively coupled to the steering system and the moldboard system. The computing system is configured to receive a desired final grade for the worksite and generate a steering path for steering the motor grader across the worksite and a moldboard control instructions for actuating the moldboard as the motor grader moves across the worksite based at least in part on the desired final grade, at least one steering performance metric of the steering system, and at least one moldboard performance metric of the moldboard system. The computing system is further configured to receive an input indicative of a ground speed of the motor grader. Additionally, the computing system is configured to control the steering system according to the steering path and the moldboard system according to the moldboard control instructions when the ground speed of the motor grader is within a threshold speed range for the steering path and the moldboard control instructions.

In an additional aspect, the present subject matter is directed to a method for automatically guiding a motor grader within a worksite. The method includes receiving, with a computing system, a desired final grade for the worksite and generating, with the computing system, a steering path for steering the motor grader across the worksite and moldboard control instructions for actuating a moldboard of the motor grader as the motor grader moves across the worksite. The method further includes controlling, with the computing system, the steering system according to the steering path and the moldboard system according to the moldboard control instructions. Further, the method includes determining, with the computing system, whether a reference point on the motor grader is offset from the steering path in a first lateral direction. Moreover, the method includes controlling, with the computing system, the moldboard system to actuate the moldboard such that the moldboard shifts in a second lateral direction opposite the first lateral direction. Additionally, the method includes controlling, with the computing system, the steering system to move the motor grader such that the reference point on motor grader moves in the second lateral direction toward the steering path as the moldboard is being actuated in the second lateral direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
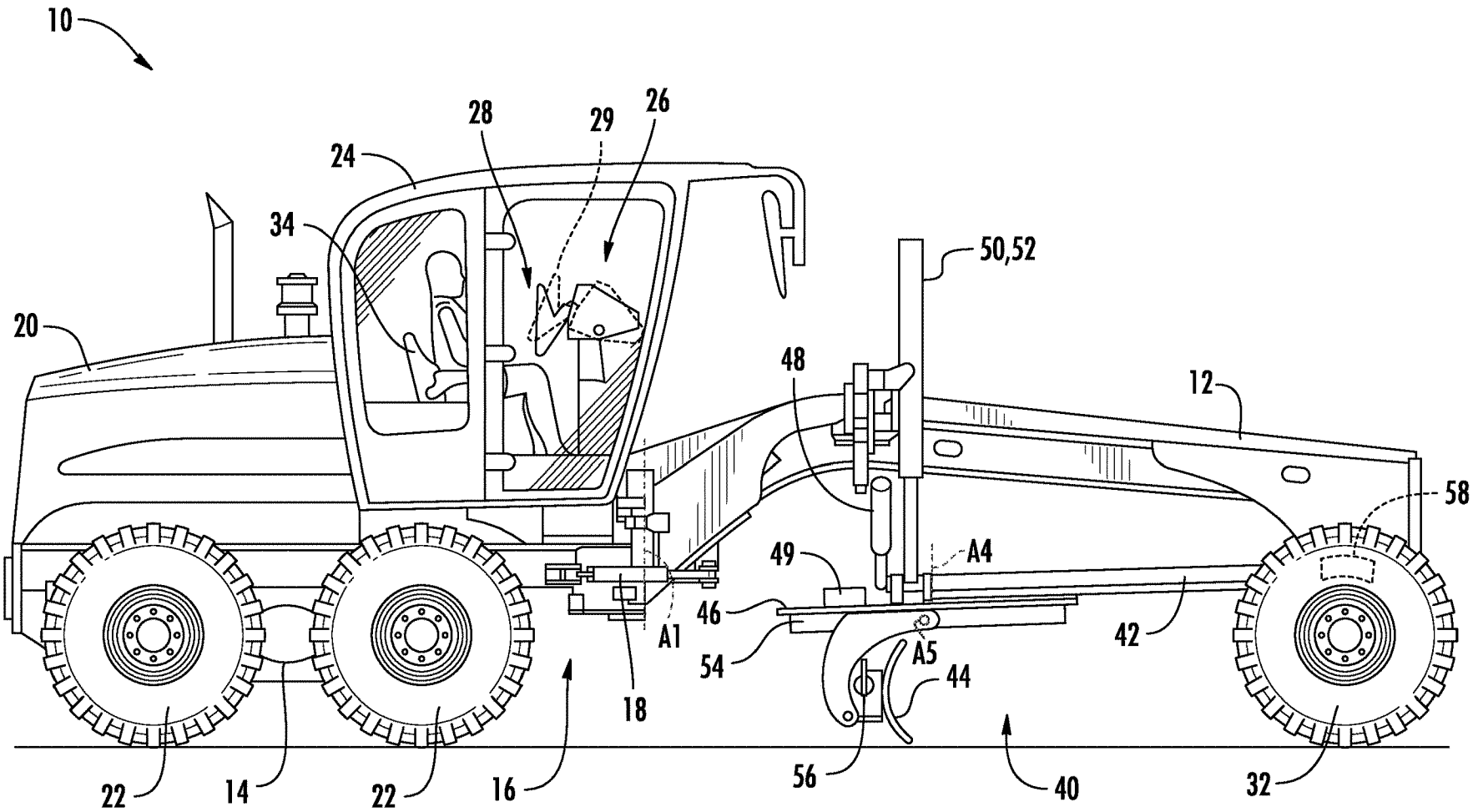
FIG. 1 illustrates a side view of one embodiment of a work vehicle in accordance with aspects of the present subject matter, particularly illustrating the work vehicle configured as a motor grader.

Repeat use of reference characters in the present specification and drawings is intended to represent the same or analogous features or elements of the present technology.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for automatically guiding a motor grader within a worksite. Specifically, in several embodiments, the system includes a steering system, a moldboard system (with the moldboard system including an actuatable moldboard), and a computing system communicatively coupled to the steering system and the moldboard system. The computing system is generally configured to generate a steering path for the steering system and moldboard control instructions for actuating the moldboard based at least in part on a desired final grade of a worksite and the capabilities of the steering system and the moldboard system. In some embodiments, the steering path and the moldboard control instructions are generated for a particular ground speed range of the motor grader. By taking into account the capabilities of the steering system and the moldboard system for a particular ground speed, an operator can optionally control the ground speed of the motor grader while the steering and moldboard systems are automatically controlled to bring the worksite to the final grade. In some embodiments, the system may account for cross-track error between the steering system and the steering path. For instance, if the motor grader is determined to be offset from the steering path, the system may be configured to control the moldboard system to perform side-shifts to help compensate for the offset and to control the steering system to steer the motor grader back onto the steering path. Alternatively, or additionally, in some embodiments, the system may help reduce the complexity of the motor grader control across multiple passes. For instance, an overlapping steering path may be generated that at least partially overlaps areas of a previous steering path, where the previous steering path is associated with moldboard shifts that create a wave pattern or include angles greater than an angle threshold. The overlapping steering path may be without a wave pattern or without angles greater than the angle threshold, creating a smoother, less complex steering path and moldboard control pattern. By automating more of the control of the motor grader, the overall efficiency may be increased for performing a grading operation, while reducing associated costs and operator fatigue.

Figure 2:
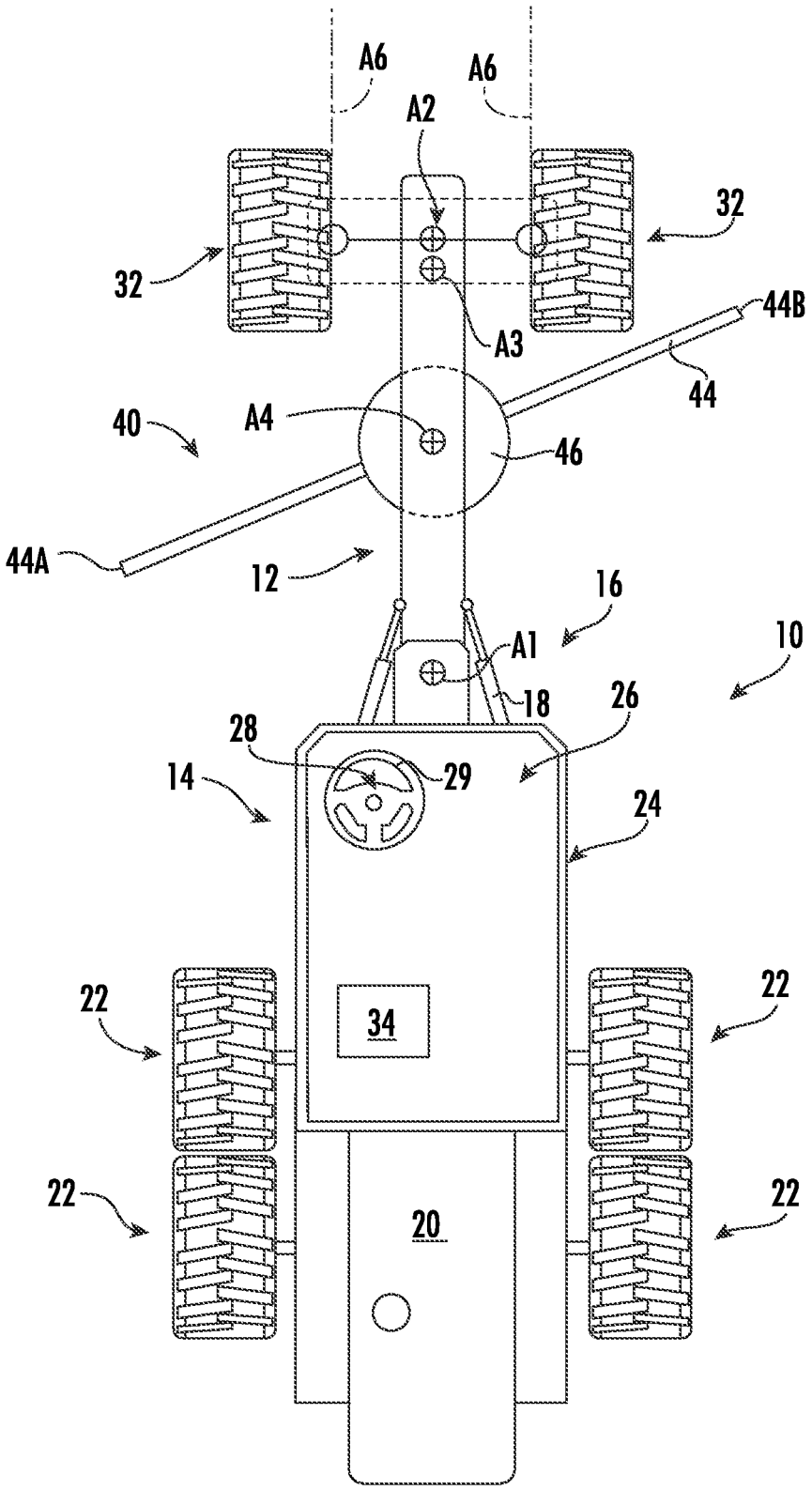
FIG. 2 illustrates a top-down view of one embodiment of a work vehicle in accordance with aspects of the present subject matter, particularly illustrating the work vehicle configured as a motor grader.

Referring now to the drawings, FIGS. 1 and 2 illustrate various views of one embodiment of a work vehicle in accordance with aspects of the present subject matter. Particularly, FIG. 1 illustrates a side view of the work vehicle and FIG. 2 illustrates a top-down view of the work vehicle. As shown, the work vehicle corresponds to a motor grader 10. However, in other embodiments, the work vehicle may correspond to any other suitable type of work vehicle, including any suitable type of construction vehicle.

The motor grader 10 has an articulating frame including a front frame portion 12 and a rear frame portion 14 pivotally connected to each other via an articulating joint 16. Accordingly, the front frame portion 12 and the rear frame portion 14 can be arranged in a straight line alignment or can be arranged at various angular relationships to the left and to the right, pivoted about a vertical axis A1 through the articulating joint 16. Additionally, one or more articulating adjustment cylinders 18 may be provided for adjusting the articulation of the vehicle 10.

Moreover, a plurality of components may be supported by or coupled to the front and rear frame portions 12, 14 of the grader 10. For example, the rear frame portion 14 may support both an engine 20 configured to provide power for driving a tandem set of driven, ground engaging rear wheels 22 supporting the rear frame portion 14 and an operator's cab 24 configured to provide an operating environment for the operator. For instance, an operator console 26 may be provided that includes or is associated with a plurality of operator controls and/or interface elements (e.g., knobs, levers, buttons, switches, display devices, etc.) for providing operator inputs to control the operation of the motor grader 10. As shown, a steering assembly 28 including, for example, a steering wheel 29 is located within the cab 24 to allow the operator to provide steering inputs for controlling one or more steering angle actuators 30 (FIG. 3) for adjusting a steering angle about a second axis A2 (FIG. 2) of a set of steerable front wheels 32 supporting the front frame portion 12. Additionally, an operator's seat 34 may be provided within the cab 24 for the operator sit on when controlling the operation of the grader 10.

The motor grader 10 also includes a moldboard assembly 40 supported relative to the front frame portion 12 by a drawbar 42 (FIG. 1). In general, the moldboard assembly 40 includes a moldboard 44 coupled to a plate gear or circle 46, which is, in turn, supported by the drawbar 42 (FIG. 1). The moldboard 44 generally extends along a length defined between a left end 44A (FIG. 2) of the moldboard 44 and a right end 44B (FIG. 2) of the moldboard 44. One or more center shift cylinders 48 (FIG. 1) are provided for controlling the angular orientation of the moldboard 44 relative to front frame portion 12 about a third axis A3 (FIG. 2) while a circle clocking drive 49 (FIG. 1) is provided to adjust the rotational orientation of the circle 46 (and, thus, the moldboard 44) relative to the drawbar 42 about a fourth axis A4. In some embodiments, the second and third axes A2, A3 may be parallel and coaxial. Additionally, lift cylinders 50, 52 (one of which is shown in FIG. 1) are operatively connected to the moldboard 44 along the left and right sides of the front frame portion 12 for lifting the moldboard 44 vertically. As is generally understood, the lift cylinders 50, 52 are independently operable and controllable so that the moldboard 44 can be lifted and held at a level orientation or with either side (i.e., the left side or the right side of the moldboard 44) held higher or lower than the other side so that the bottom or cutting edge of moldboard 44 is at an angle to horizontal. Moreover, as shown in FIG. 1, one or more tilt cylinders 54 are provided to adjust the relative position of the top edge of the moldboard 44 with respect to the bottom edge of moldboard 44 so that moldboard 44 can be tilted forward or backward about a fifth axis A5 to adjust the pitch of the moldboard 44. Furthermore, one or more side-shift cylinders 56 (one of which is shown in FIG. 1) adjust the moldboard 44 laterally toward either side from the centerline of the front frame portion 12 to move the windrow of material forming at the heel end of the moldboard 44 away from the travel path of the rear wheels 22, and/or to reach material outside the intended drive path.

Additionally, in one embodiment, the front wheels 32 are provided with a wheel lean control system for leaning or tilting the front wheels 32 to either side of true vertical about respective sixth axes A6 (FIG. 2). For instance, one or more lean cylinders 58 (FIG. 1) may be provided in operative association with each of the front wheels 32 to allow the wheels 32 to be leaned or tilted relative to vertical. As is generally understood, wheel lean can be used to counteract draft forces operating against the motor grader 10 traveling in the desired direction.

Figure 3:
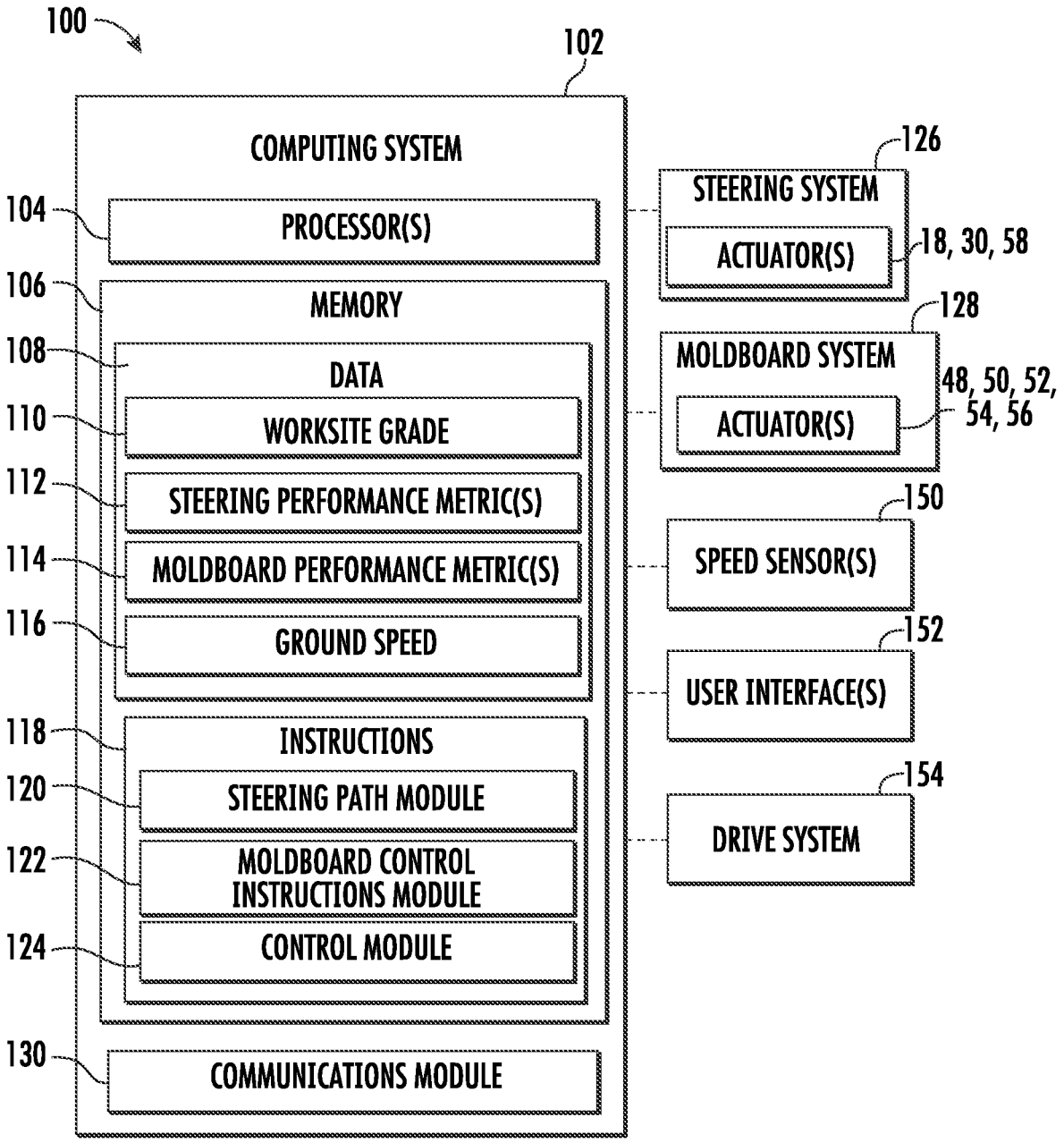
FIG. 3 illustrates a schematic view of a system for automatically guiding a motor grader within a worksite in accordance with aspects of the present subject matter.

Referring now to FIG. 3, a schematic view of one embodiment of a control system 100 for automatically guiding a motor grader within a worksite is illustrated in accordance with aspects of the present subject matter. In general, the control system 100 will be described herein with reference to the motor grader 10 described with reference to FIGS. 1 and 2. However, it should be appreciated that the disclosed control system 100 may be used with any suitable motor grader having any other suitable motor grader configuration and/or with any other suitable type of work vehicle.

As shown, the control system 100 may include any combination of components of the motor grader 10 described above with reference to FIGS. 1 and 2. For instance, the system 100 may include one or more actuators (e.g., the articulating adjustment cylinder(s) 18, the steering angle actuator(s) 30, and/or the lean cylinder(s) 58) of a steering system 126 for controlling the steering of the motor grader 10, and one or more of actuators (e.g., the center shift cylinder(s) 48, the lift cylinders 50, 52, the tilt cylinder(s) 54, and/or the side-shift cylinder(s) 56) of a moldboard system 128 for controlling the actuation of the moldboard 44 of the motor grader 10. Further, the control system 100 may include one or more speed sensors 150 configured to generate data indicative of a ground speed of the motor grader 10.

Additionally, as shown in FIG. 3, the computing system 100 may include a computing system 102 installed on and/or otherwise provided in operative association with the motor grader 10. In general, the computing system 102 may correspond to any suitable processor-based device(s), such as a computing device or any combination of computing devices. Thus, in several embodiments, the computing system 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the computing system 102 may generally comprise memory element(s) including, but not limited to, computer readable medium (e.g., random access memory (RAM)), computer readable non-volatile medium (e.g., a flash memory), and/or other suitable memory elements. Such memory device(s) 106 may generally be configured to store suitable computer-readable instructions that, when implemented by the processor(s) 104, configure the computing system 102 to perform various computer-implemented functions, such as one or more aspects of the control algorithms and/or methods described herein.

In one embodiment, the memory 106 of the computing system 102 may include one or more databases for storing information associated with the operation of the motor grader 10, including data 108 associated with automatically guiding the motor grader 10 within a worksite. For instance, as shown in FIG. 3, the memory 106 may include a worksite grade database 110 for storing data associated with a current grade of a worksite and/or a desired final grade of the worksite. Specifically, the worksite grade data 110 may include a 2D and/or 3D map of the current grade of the worksite and/or a 2D and/or 3D map of the desired final grade of the worksite. The current grade and/or the final grade may include boundaries which should not be interfered or crossed by the motor grader 10. In some embodiments the map(s) may be predetermined and uploaded to the memory 106 and/or may be at least partially generated in real-time based on sensor data from one or more environmental sensors on the motor grader 10.

The memory 106 may further include a steering performance metric(s) database 112 for storing data associated with one or more steering performance metrics of the steering system 126 of the motor grader. For instance, the steering performance metric(s) data 112 may include at least one of a turning radius of the motor grader 10 (e.g., of the front wheels 32 about the second axis A2), an articulation radius of the motor grader 10 (e.g., of the front frame 12 relative to the rear frame 14 about the first axis A1), a wheel lean range of the front wheels 32 about the sixth axes A6, and/or the like. Similarly, the memory 106 may further include a moldboard performance metric(s) database 114 for storing data associated with one or more moldboard performance metrics of the moldboard system 128 of the motor grader 10. For instance, the moldboard performance metric(s) data 114 may include a side-shift range of the moldboard 44 (e.g., an actuation range of the side-shift actuator 56), a rotation range of the moldboard 44 (e.g., about the fourth axis A4), a lift range of the moldboard 44 (e.g., an actuation range of the actuator(s) 50, 52), a tilt range of the moldboard 44 (e.g., about the fifth axis A5), the length of the moldboard 44, a selected reference point along the length of the moldboard 44, and/or the like. It should be appreciated that the performance metric(s) of the steering system 126 and/or of the moldboard system 128 may, in some embodiments, be associated with a particular ground speed and/or ground speed range of the motor grader 10, as will be described in greater detail below.

Additionally, the memory 106 may include a ground speed database 116 for storing data indicative of a ground speed of the motor grader 10 (e.g., data received from the speed sensor(s) 150). In one embodiment, the speed sensor(s) 150 may include any suitable sensor positioned at any suitable location on the motor grader 10 for generating data indicative of the ground speed of the motor grader 10, such as a radar sensor, a GPS sensor, and/or the like. In some embodiments, the speed sensor(s) 150 may be part of the drive system to monitor an operating parameter (e.g., rotational speed, rotational acceleration, and/or the like) of one or more components of a drive system 154 of the grader 10 (e.g., engine 20, transmission, and/or the like) indicative of the grader ground speed.

Referring still to FIG. 3, in several embodiments, the memory 106 of the computing system 102 may store instructions 118 that, when executed by the processor(s) 104, configure the computing system 102 to execute a steering path module 120 for generating a steering path along which the motor grader 10 will be steered across a worksite. Specifically, the steering path module 120 may be configured to generate the steering path based at least in part on a current grade of the worksite and/or a final grade of the worksite from the worksite database 110, the steering performance metric(s) of the steering system 126, and/or the moldboard performance metric(s) of the moldboard system 128. The steering path may generally include a plurality of passes across the worksite. Similarly, the memory 106 of the computing system 102 may store instructions 118 that, when executed by the processor(s) 104, configure the computing system 102 to execute a moldboard control instructions module 122 for generating moldboard control instructions to articulate the moldboard 44 as the motor grader 10 is moved across the worksite (e.g., along the steering path). The moldboard control instructions module 122 may be configured to generate the moldboard control instructions based at least in part on the current grade of the worksite and/or the final grade of the worksite from the worksite database 110, the moldboard performance metric(s) of the moldboard system 128, and/or the steering performance metric(s) of the steering system 126.

The steering path module 120 may generate a steering path for the motor grader 10 with reference to a reference point on a frame of the motor grader 10, such as a center of a front axle, between the front wheels, or at any other fixed point on the motor grader 10. Similarly, the moldboard control instructions module 122 may generate moldboard control instructions with reference to a moldboard reference point along a length of the moldboard 44, such as the left end 44A, the right end 44B, or center of the moldboard 44. It should be appreciated that the reference points may be predetermined and stored within the memory 106 of the computing system 102 or may be selected by an operator, such as via a user interface (e.g., user interface 152). As such, the steering path module 120 and/or the moldboard control instructions module 122 may be configured to access the motor grader reference point and/or access the location of a moldboard reference point along the length of the moldboard from the memory 106, such as from the metric(s) database(s) 112, 114.

Figure 4A:
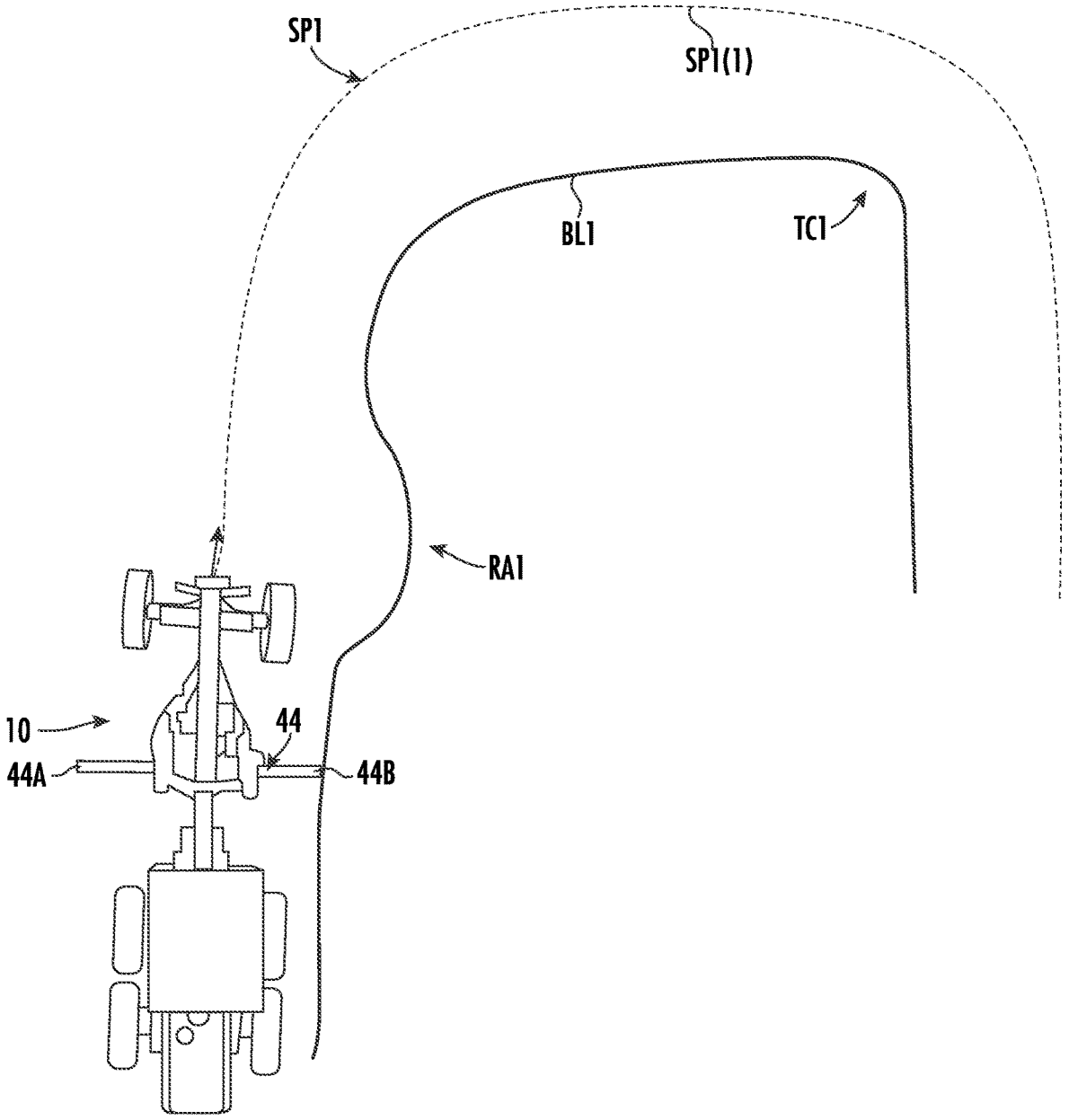
FIGS. 4A-4C illustrate an example embodiment of a steering path for steering a motor grader across a worksite and related moldboard control instructions for moving a moldboard of the motor grader as the motor grader moves across the worksite in accordance with aspects of the present subject matter.
Figure 4B:
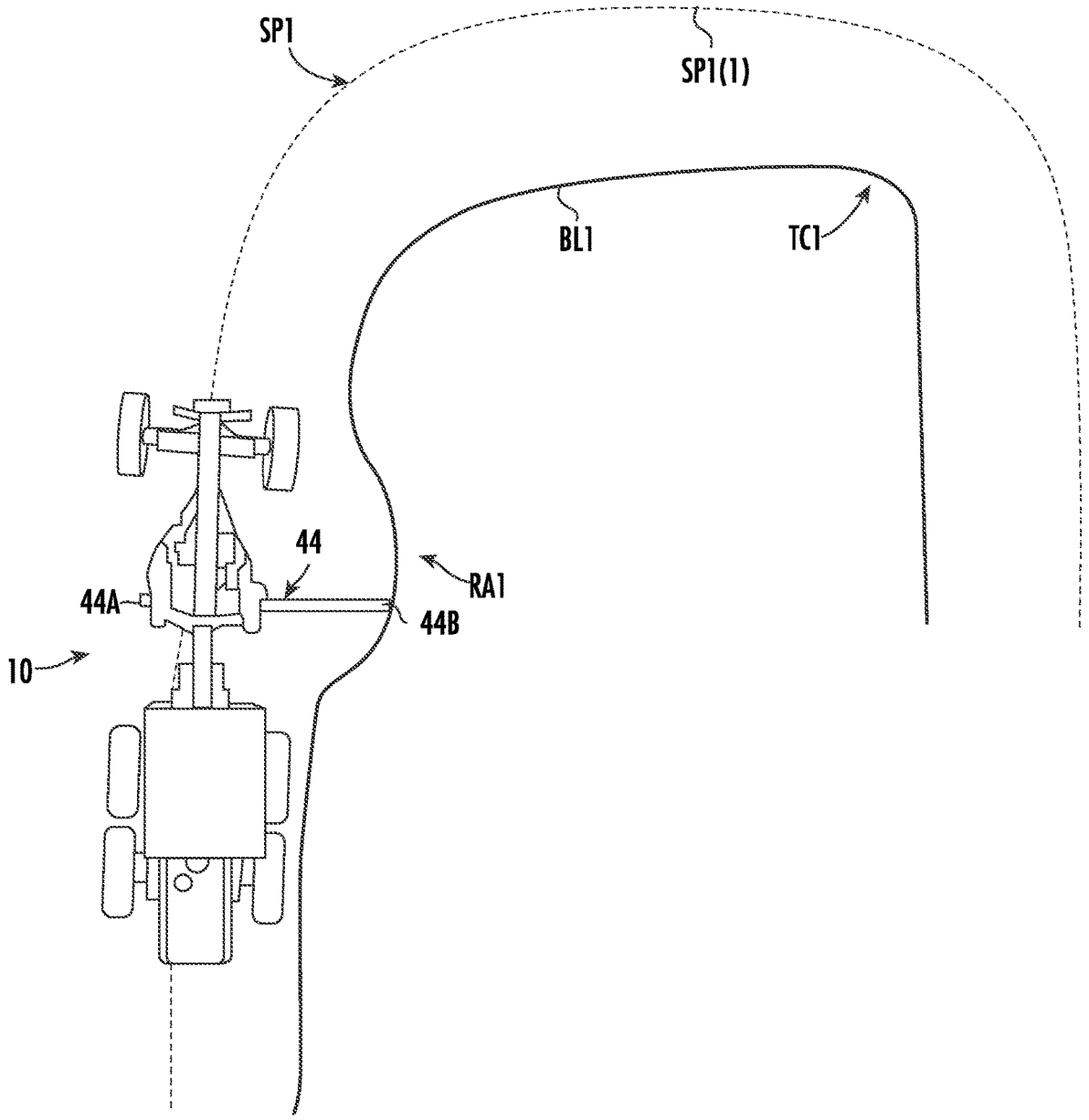
Figure 4C:
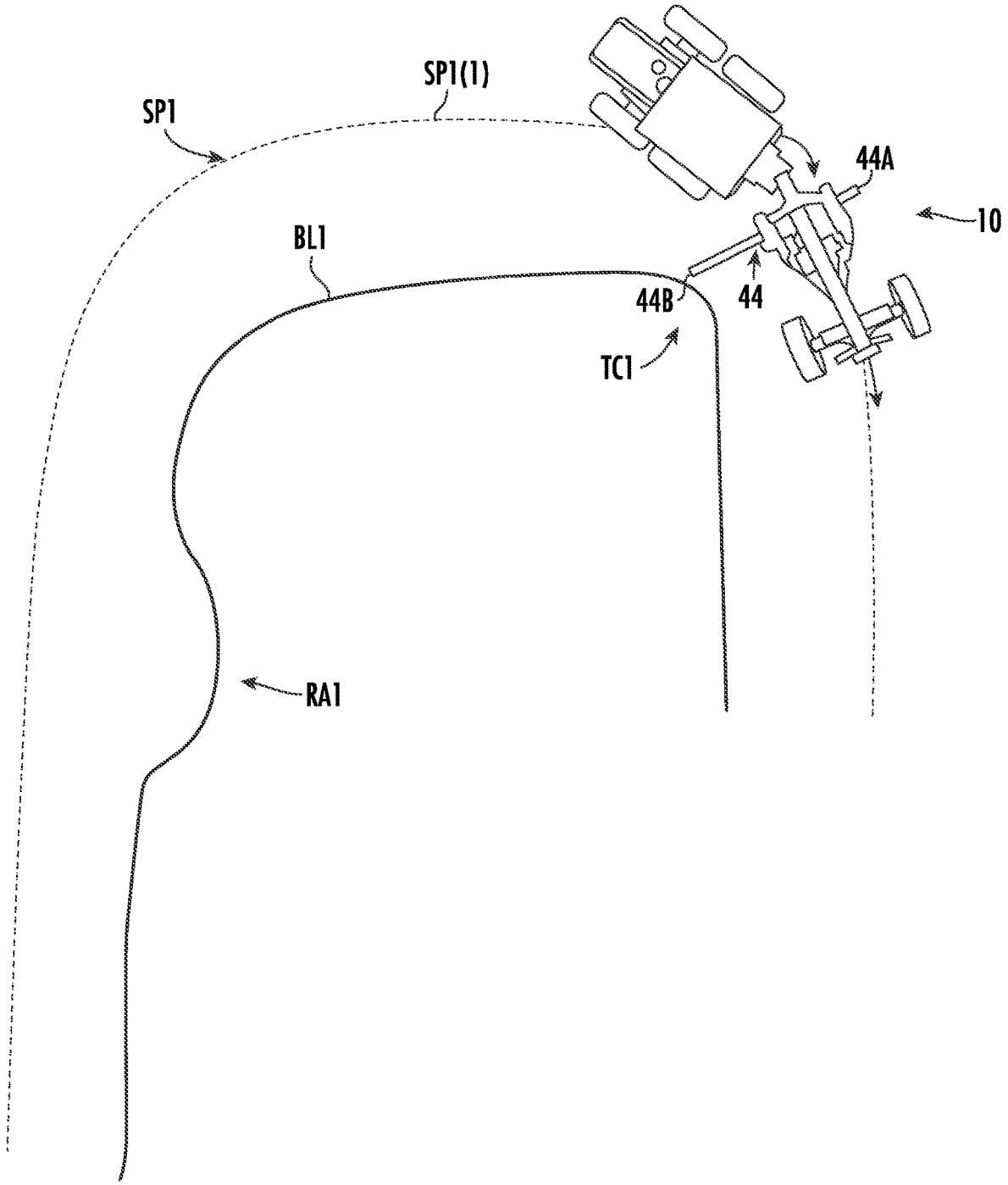
Figure 5:
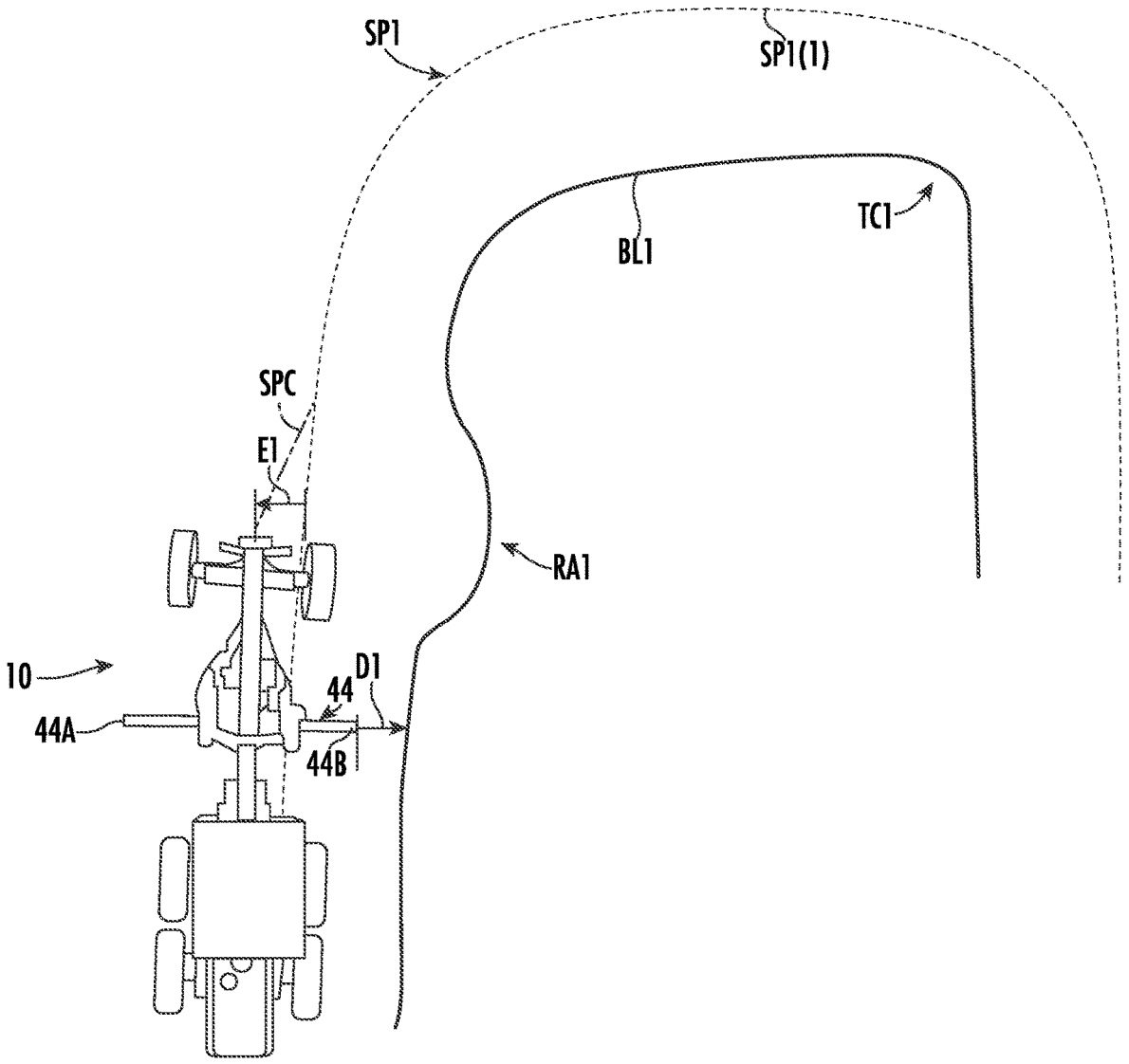
FIG. 5 illustrates another example embodiment of a steering path for steering a motor grader across a worksite and related moldboard control instructions for moving a moldboard of the motor grader as the motor grader moves across the worksite in accordance with aspects of the present subject matter, particularly illustrating a cross-track error.
Figure 6:
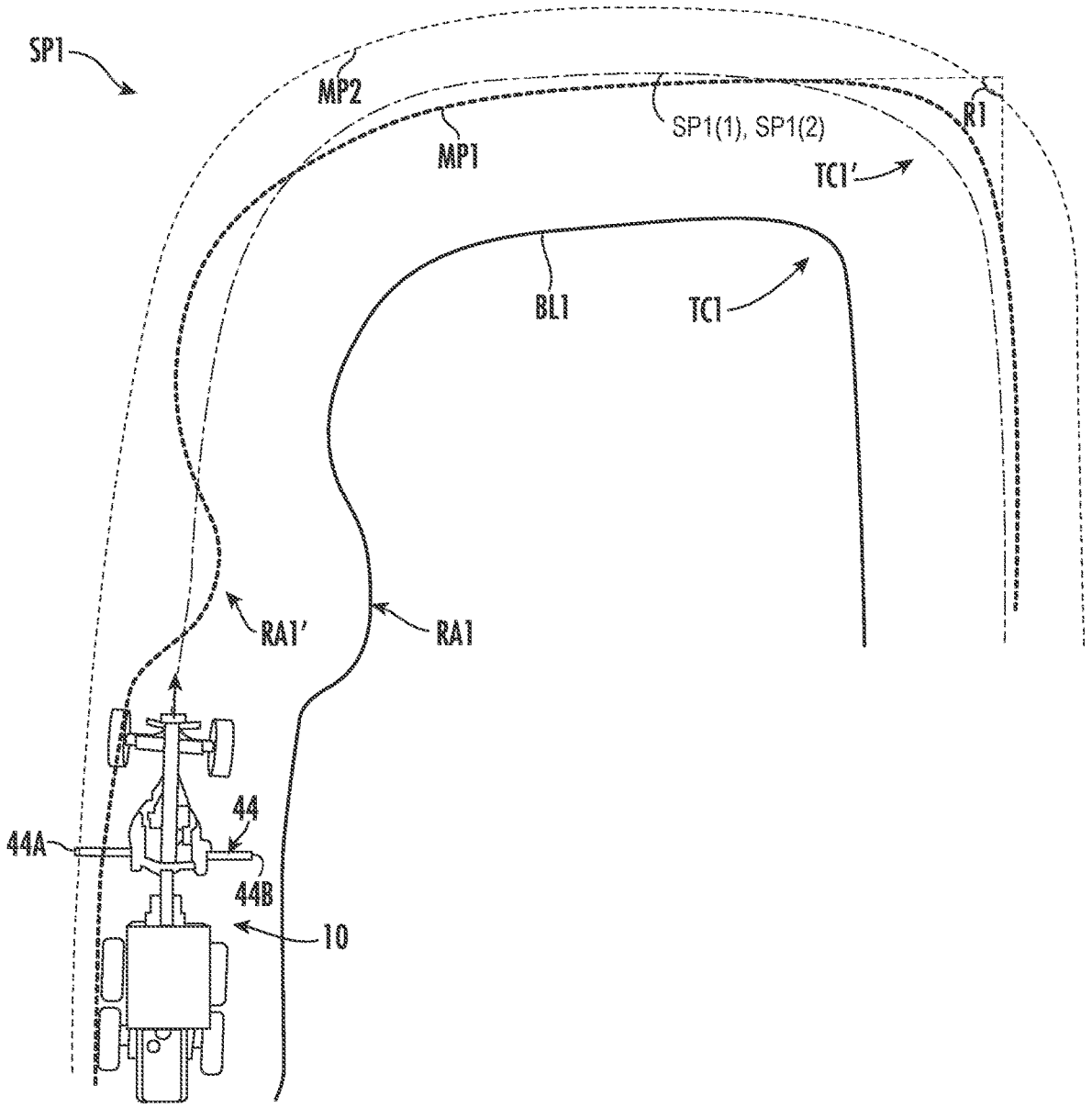
FIG. 6 illustrates an additional example embodiment of a steering path for steering a motor grader across a worksite and related moldboard control instructions for moving a moldboard of the motor grader as the motor grader moves across the worksite in accordance with aspects of the present subject matter, particularly illustrating an intermediate steering pass and related moldboard control instructions.

For instance, referring to FIGS. 4A-6, various example embodiments of steering paths and related moldboard control instructions are shown in accordance with aspects of the present subject matter. Particularly, FIGS. 4A-4C illustrate a first example embodiment of a steering path for steering a motor grader across a worksite and related moldboard control instructions for moving a moldboard of the motor grader as the motor grader moves across the worksite. FIG. 5 illustrates another example embodiment of a steering path for steering a motor grader across a worksite and related moldboard control instructions for moving a moldboard of the motor grader as the motor grader moves across the worksite, particularly illustrating a cross-track error. Additionally, FIG. 6 illustrates an additional example embodiment of a steering path for steering a motor grader across a worksite and related moldboard control instructions for moving a moldboard of the motor grader as the motor grader moves across the worksite, particularly illustrating an intermediate steering pass and related moldboard control instructions.

As shown in FIGS. 4A-6, a boundary line, such as a first boundary line BL1, may be received as part of the grade data 110 for a worksite. The steering path and the moldboard control instructions may generally be generated such that the motor grader 10 is able to work as close as possible to the boundary line BL1, or up to a predefined offset from the boundary line BL1, without crossing over the boundary line BL1. In some embodiments, the boundary line BL1 includes areas that are difficult to navigate. For instance, in the illustrated example, the boundary line BL1 includes a radiused portion RA1 (e.g., for a man-hole or a drain) that forms a wave pattern, and a tight cornered portion TC1. Using the steering performance metric(s) 112 of the steering system 126 of the motor grader (e.g., the turning radius, the articulation radius, the wheel lean range), the steering path module 120 may determine that the motor grader 10 cannot be steered along the radiused portion RA1 without intersecting or crossing the boundary line BL1. As such, a steering path SP1 generated by the steering path module 120 includes a first steering pass SP1(1) that essentially ignores the radiused portion RA1 of the boundary line BL1 by including a substantially straight portion adjacent the radiused portion RA1 of the boundary line BL1 instead of trying to follow or match the radiused portion RA1. The moldboard control instructions module 122 may determine that the performance metrics of the moldboard system 128 allow the moldboard 44 to overcome the deficiencies of the steering system 126. As such, moldboard control instructions generated by the moldboard control instructions module 122 account or compensate for the radiused portion RA1 of the boundary line BL1 by including instructions to actuate the moldboard 44. For instance, as shown in FIG. 4B, the moldboard instructions call for side-shifting the moldboard 44 to the right relative to the direction of travel to follow the radiused portion RA1 as the motor grader 10 is steered past the radiused portion RA1 along the first steering pass SP1(1) of the steering path SP1.

Similarly, using the steering performance metric(s) 112 of the steering system 126 of the motor grader (e.g., the turning radius, the articulation radius, the wheel lean range), the steering path module 120 may determine that the motor grader 10 cannot be steered by turning the front wheels alone without intersecting or crossing the tight cornered portion TC1 of the boundary line BL1. As such, as shown in FIG. 4C, the first steering pass SP1(1) of the steering path SP1 generated by the steering path module 120 calls for articulation of the front frame of the motor grader relative to the rear frame in addition to turning and/or leaning the front wheels. The moldboard control instructions module 122 may determine that the performance metrics of the moldboard system 128 allow the moldboard 44 to overcome the deficiencies of the steering system 126. As such, the moldboard control instructions include instructions to actuate the moldboard 44. For instance, as shown, the moldboard instructions may require side-shifting the moldboard 44 to follow the tight cornered portion TC1 as the motor grader 10 is steered past the tight cornered portion TC1 along the first steering pass SP1(1) of the steering path SP1. However, it should be appreciated that the moldboard instructions may also require rotation of the moldboard 44 or may require no actuation of the moldboard 44.

In some instances, a cross-track error may occur where the reference point of the motor grader 10 is offset from the steering path. For example, as shown in FIG. 5, the reference point on the motor grader 10 is the center of the front axle, but the reference point is offset by an error distance E1 to the left of the first steering pass SP1(1) of the steering path SP1 relative to the direction of travel of the motor grader 10. In general, actuation of the moldboard 44 in response to control instructions may occur faster than steering changes of the motor grader 10. As such, the moldboard control instructions may be updated by the moldboard control instructions module 122 to initially compensate for the error distance E1 by side-shifting the moldboard. For instance, the updated moldboard control instructions may generally offset the original moldboard control instructions by a distance D1 in an opposite direction of the error E1 (e.g., to the right) relative to the direction of travel of the motor grader 10, where the distance D1 is equal to at least a portion of the error distance E1. As such, the moldboard 44 may be side-shifted to the right to at least partially account for the error distance E1 of the motor grader 10 to the left. The steering path module 120 may additionally update the steering path SP1 to include a steering path correction portion SPC along the first steering pass SP1(1) such that the reference point on motor grader (e.g., center of the front axle) will be steered to the right, toward the first steering pass SP1(1) of the steering path SP1, as the moldboard 44 is actuated to the right. The updated moldboard control instructions may taper the distance D1 to account for the motor grader 10 being steered along the steering path correction portion SPC toward the first steering pass SP1(1), as the remaining offset or error distance E1 is reduced between the reference point on the motor grader 10 and the first steering pass SP1(1). For instance, in some cases, the moldboard control instructions may include actuating the moldboard 44 to side-shift back to the left as the motor grader 10 is steered along the steering path correction SPC toward the first steering pass SP1(1). Once the reference point on the motor grader 10 is back on the steering path SP1, the steering path SP1 and the original moldboard control instructions may again be followed.

Additionally, in some instances, it may be desirable to reduce the amount of actuation of the moldboard 44. For instance, as shown in FIG. 6, when the first steering pass SP1(1) of the steering path SP1 is followed, the left end 44A of the moldboard 44 moves along a first moldboard path MP1. Typically, the first moldboard path MP1 is used as a boundary line for generating a subsequent pass of the steering path SP1. However, as shown, the first moldboard path MP1 is similar to the first steering pass SP1(1) and includes a radiused portion RA1' having a wave pattern and a tight cornered portion TC1' creating an angle R1 that is greater than an angle threshold. Typically, at least several passes of the steering path SP1 across the worksite subsequent to the first steering pass SP1(1) would include similar radiused and tight cornered areas. Accordingly, the steering path module 122 may include an intermediate pass that straightens out or removes the need for such repeated radiused and tight cornered areas. For instance, in one embodiment, the steering path SP1 includes a second steering pass SP1(2) across the worksite, where the second steering pass SP1(2) at least partially overlaps the first steering pass SP1(1). Particularly, it is preferred that the second steering pass SP1(2) at least partially overlaps the first steering pass SP1(1) adjacent the radiused and tight cornered areas RA1, TC1. In some embodiments, such as the embodiment shown, the second steering pass SP1(2) completely overlaps the first steering pass SP1(1). The moldboard control instructions associated with the second steering pass SP1(2) do not include at least the side-shifting at the radiused portion RA1' and a tight cornered portion TC1' as in the moldboard control instructions associated with the first steering pass SP1(1). In some embodiments, the moldboard control instructions associated with the second steering pass SP1(2) do not require any side-shifting of the moldboard 44, or any actuation of the moldboard 44. For instance, a second moldboard pass MP2 showing the movements of the left end 44A of the moldboard 44 according to the moldboard control instructions associated with the second steering pass SP1(2) is shown in FIG. 6. The portions of the second moldboard pass MP2 adjacent the radiused and tight cornered portions RA1, TC1 of the boundary line BL1 are without a wave pattern or angles greater than the angle threshold. As such, moldboard control instructions associated with subsequent steering passes across the worksite may also be without waves or tight angles, regardless of the wave pattern or tight corners of the moldboard control instructions associated with the first steering pass SP1(1).

Referring back to FIG. 3, the memory 106 of the computing system 102 may store instructions that, when executed by the processor(s) 104, configure the computing system 102 to execute a control module 124 to automatically guide the motor grader 10 within a worksite. For instance, the control module 124 may be configured to control an operation of the steering system 126 (e.g., of the steering system actuator(s) 18, 30, 58) according to the steering path generated by the steering path module 120 to steer the motor grader 10 along the steering path SP1 (e.g., along the passes SP1(1), SP(2), etc. of the steering path SP1). Similarly, the control module 124 may be configured to control an operation of the moldboard system 128 (e.g., of the moldboard actuator(s) 48, 50, 52, 54, 56) to actuate the moldboard 44 according to the moldboard control instructions generated by the moldboard control instructions module 122 as the motor grader 10 is steered across the worksite.

In one embodiment, as indicated above, the steering path and the moldboard control instructions may be generated for a particular ground speed range of the motor grader 10. As such, the control module 124 may first be configured to determine if the current ground speed of the motor grader 10 is within the ground speed range for the steering path and the moldboard control instructions. If it is determined that the current ground speed of the motor grader 10 is within the ground speed range, the steering system 126 may be controlled according to the steering path already generated and the moldboard system 128 may be controlled according to the moldboard control instructions already generated. Otherwise, if it is determined that the current ground speed of the motor grader 10 is outside of the ground speed range, the control module 124 may require the steering path module 120 to generate an updated steering path and/or the moldboard control instructions module 122 to generate updated moldboard control instructions, and/or may require the ground speed of the motor grader 10 to be adjusted to be within the ground speed range.

In some embodiments, the control module 124 may be further configured to control an operation of a user interface 152 associated with the motor grader 10. In general, the user interface 152 may correspond to any suitable input device(s) configured to allow the operator to provide operator inputs to the computing system 102, such as a touch screen display, a keyboard, joystick, buttons, knobs, switches, and/or combinations thereof located within the cab 24 of the motor grader 10. The operator may provide various inputs into the system 102 via the user interface 152. In one embodiment, suitable operator inputs may include, but are not limited to, a moldboard reference point along the length of the moldboard 44, a ground speed of the motor grader 10, and/or any other parameter associated with operating the grader 10. In addition, the user interface 152 may also be configured to provide feedback (e.g., feedback associated with the location of the grader 10 relative to the steering path, ground speed, and/or the like) to the operator. As such, the user interface 152 may include one or more output devices (not shown), such as display screens, speakers, warning lights, and/or the like, which are configured to provide feedback from the computing system 102 to the operator. For example, the computing system 102 may control an operation of the user interface 152 to indicate to the operator of the motor grader 10 that the ground speed of the motor grader 10 is outside of the ground speed range, and/or indicate suggested actions.

Alternatively, or additionally, in some embodiments, the control module 124 may be further configured to control an operation of the drive system 154 of the motor grader 10. For instance, if the ground speed of the motor grader 10 is determined to be outside of the ground speed range for the steering path and/or moldboard control instructions, the control module 124 may be configured to automatically control an operation of one or more components of the drive system 154 to increase or decrease the ground speed of the motor grader 10.

It should be appreciated that the computing system 102 may also include various other suitable components, such as a communications circuit or module 130, a network interface, one or more input/output channels, a data/control bus and/or the like, to allow the computing system 102 to be communicatively coupled with any of the various other system components described herein.

Figure 7:
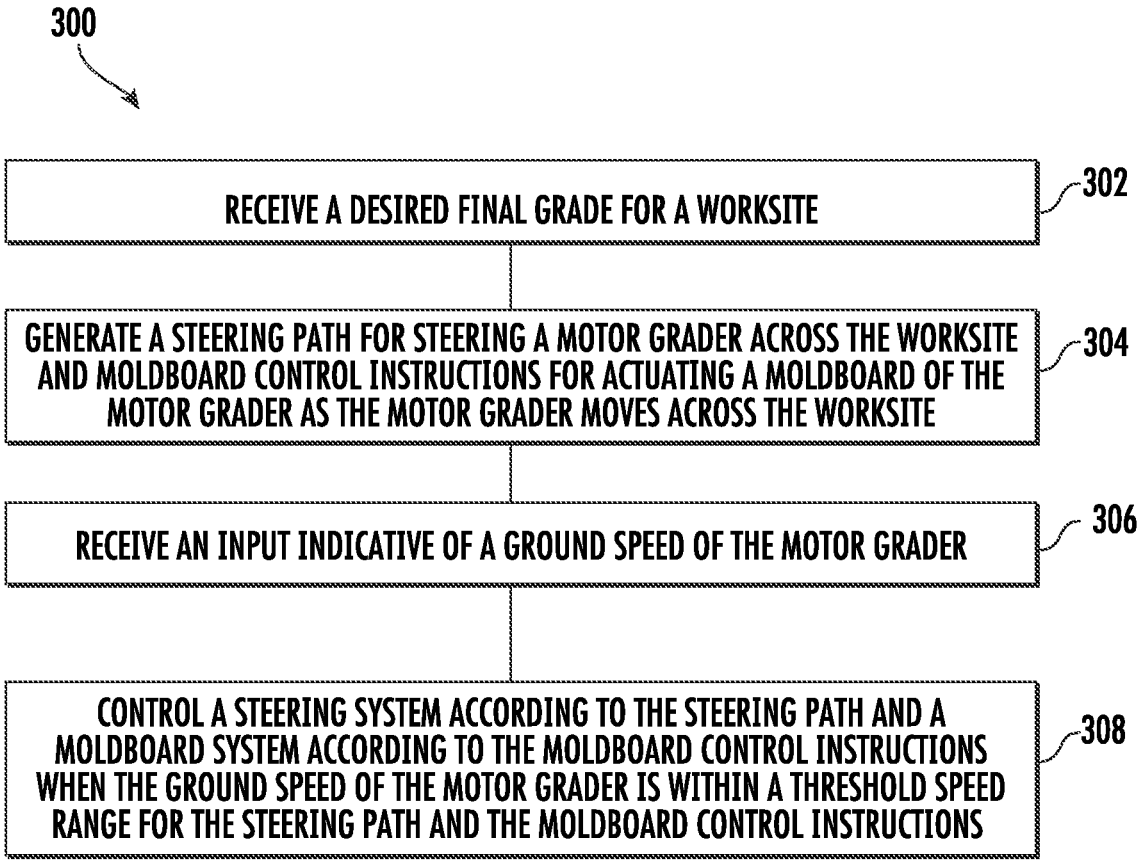
FIG. 7 illustrates a flow diagram of one embodiment of a method for automatically guiding a motor grader within a worksite in accordance with aspects of the present subject matter.

Referring now to FIG. 7, a flow diagram of one embodiment of a method 300 for automatically guiding a motor grader within a worksite is illustrated in accordance with aspects of the present subject matter. In general, the method 300 will be described herein with reference to the motor grader 10 described above with reference to FIGS. 1-2, the system 100 described above with reference to FIG. 3, and the example embodiments of steering paths and related moldboard control instructions shown in FIGS. 4A-6. However, it should be appreciated that the disclosed method 300 may be implemented with motor graders having any other suitable motor grader configuration, with systems having any other suitable system configuration, and/or in connection with any other suitable steering paths and related moldboard control instructions. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (302), the method 300 may include receiving a desired final grade for a worksite. For instance, as described above, the final grade for a worksite may include a 2D and/or 3D map of the desired final grade of the worksite, which may include boundaries or features which should not be crossed or intersected by the motor grader 10.

At (304), the method 300 may include generating a steering path for steering a motor grader across the worksite and moldboard control instructions for actuating a moldboard of the motor grader as the motor grader moves across the worksite. For example, as indicated above, the steering path module 120 may be configured to generate a steering path, such as the steering path SP1, based at least in part on the final grade (e.g., the boundary line BL1), at least one steering performance metric 112 of a steering system (e.g., steering system 126) of the motor grader 10, and at least one moldboard performance metric of a moldboard system (e.g., moldboard system 128) of the motor grader 10. Similarly, the moldboard control instructions module 122 may be configured to generate moldboard control instructions based at least in part on the final grade (e.g., the boundary line BL1), at least one moldboard performance metric of the moldboard system 128 of the motor grader 10, and at least one steering performance metric 112 of the steering system 126 of the motor grader 10.

Further, at (306), the method 300 may include receiving an input indicative of a ground speed of the motor grader. For instance, as indicated above, the control system 100 may receive data indicative of a ground speed of the motor grader 10, such as data from the speed sensor(s) 150.

Additionally, at (308), the method 300 may include controlling a steering system according to the steering path and a moldboard system according to the moldboard control instructions when the ground speed of the motor grader is within a threshold speed range for the steering path and the moldboard control instructions. As indicated above, the steering path and/or moldboard control instructions may be based at least in part on a threshold ground speed range of the motor grader 10. Thus, when the ground speed of the motor grader 10 is within the threshold speed range, the control system 100 may control the operation of the steering system 126 based at least in part on the steering path and the moldboard system 128 based at least in part on the moldboard control instructions.

Figure 8:
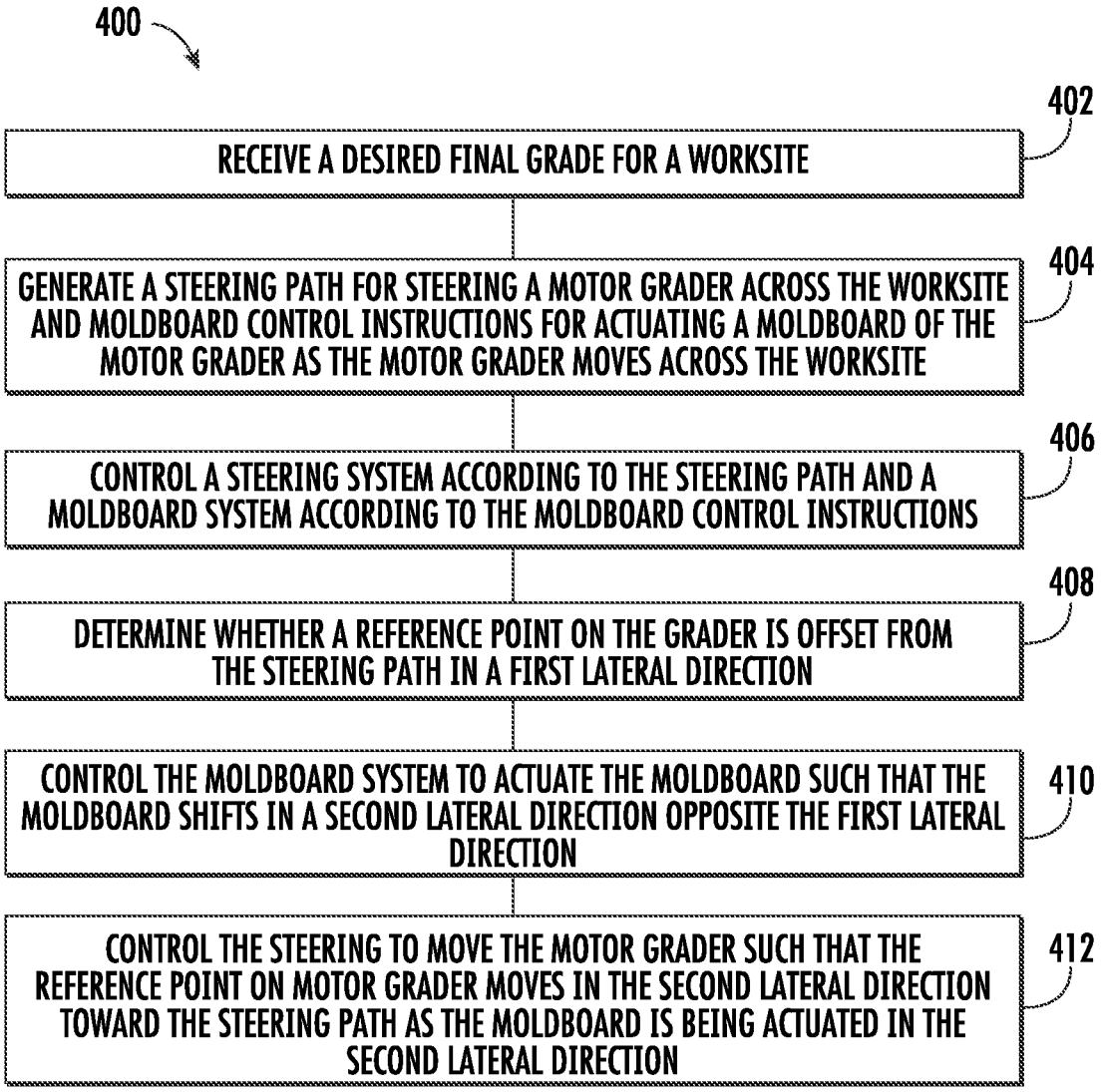
FIG. 8 illustrates a flow diagram of another embodiment of a method for automatically guiding a motor grader within a worksite in accordance with aspects of the present subject matter.

Referring now to FIG. 8, a flow diagram of one embodiment of a method 400 for automatically guiding a motor grader within a worksite is illustrated in accordance with aspects of the present subject matter. In general, the method 400 will be described herein with reference to the motor grader 10 described above with reference to FIGS. 1-2, the system 100 described above with reference to FIG. 3, and the example embodiments of steering paths and related moldboard control instructions shown in FIGS. 4A-6. However, it should be appreciated that the disclosed method 400 may be implemented with motor graders having any other suitable motor grader configuration, with systems having any other suitable system configuration, and/or in connection with any other suitable steering paths and related moldboard control instructions. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 8, at (402), the method 400 may include receiving a desired final grade for a worksite. For instance, as described above, the final grade for a worksite may include a 2D and/or 3D map of the desired final grade of the worksite, which may include boundaries or features which should not be crossed or intersected by the motor grader 10.

At (404), the method 400 may include generating a steering path for steering a motor grader across the worksite and moldboard control instructions for actuating a moldboard of the motor grader as the motor grader moves across the worksite. For example, as described above, the steering path module 120 may be configured to generate a steering path, such as the steering path SP1, based at least in part on the final grade (e.g., the boundary line BL1), at least one steering performance metric 112 of a steering system (e.g., the steering system 126) of the motor grader 10, and at least one moldboard performance metric of a moldboard system (e.g., the moldboard system 128) of the motor grader 10. Similarly, the moldboard control instructions module 122 may be configured to generate moldboard control instructions based at least in part on the final grade (e.g., the boundary line BL1), at least one moldboard performance metric of the moldboard system 128 of the motor grader 10, and at least one steering performance metric 112 of the steering system 126 of the motor grader 10.

Further, at (406), the method 400 may include controlling a steering system according to the steering path and a moldboard system according to the moldboard control instructions. As indicated above, the control system 100 may control the operation of the steering system 126 based at least in part on the steering path and the moldboard system 128 based at least in part on the moldboard control instructions.

Moreover, at (408), the method 400 may include determining whether a reference point on the motor grader is offset from the steering path in a first lateral direction. For example, as discussed above, during a cross-track error, the reference point (e.g., a center of the front axle) of the motor grader 10 may become offset from the steering path (e.g., a first steering pass SP1(1) of the steering path SP1) in a first direction.

Further still, at (410), the method 400 may include controlling the moldboard system to actuate the moldboard such that the moldboard shifts in a second lateral direction opposite the first lateral direction. For instance, as indicated above, the control system 100 may control the operation of the moldboard system 128 to actuate the moldboard 44 such that the moldboard 44 shifts in a second lateral direction opposite the first lateral direction.

Additionally, at (412), the method 400 may include controlling the steering system to move the motor grader such that the reference point on the motor grader moves in the second lateral direction toward the steering path as the moldboard is being actuated in the second lateral direction. For example, as indicated above, the control system 100 may control the operation of the steering system 126 to move the motor grader 10 such that the reference point (e.g., the center of the front axle) on the motor grader 10 moves in the second lateral direction toward the steering path (e.g., the first steering pass SP1(1) of the steering path (SP1) as the moldboard 44 is actuated in the second lateral direction.

It is to be understood that the steps of the methods 300, 400 are performed by the computing system 100 upon loading and executing software code or instructions which are tangibly stored on a tangible computer readable medium, such as on a magnetic medium, e.g., a computer hard drive, solid-state memory, e.g., flash memory, or other storage media known in the art. Thus, any of the functionality performed by the computing system 100 described herein, such as the methods 300, 400, is implemented in software code or instructions which are tangibly stored on a tangible computer readable medium. The computing system 100 loads the software code or instructions via a direct interface with the computer readable medium or via a wired and/or wireless network. Upon loading and executing such software code or instructions by the computing system 100, the computing system 100 may perform any of the functionality of the computing system 100 described herein, including any steps of the methods 300, 400 described herein.

The term "software code" or "code" used herein refers to any instructions or set of instructions that influence the operation of a computer or computing system. They may exist in a computer-executable form, such as machine code, which is the set of instructions and data directly executed by a computer's central processing unit or by a computing system, a human-understandable form, such as source code, which may be compiled in order to be executed by a computer's central processing unit or by a computing system, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a computing system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for automatically guiding a motor grader within a worksite, the method comprising:

receiving, with a computing system, a desired final grade for the worksite;

generating, with the computing system, a steering path for steering the motor grader across the worksite and moldboard control instructions for actuating a moldboard of the motor grader as the motor grader moves across the worksite based at least in part on the desired final grade, at least one steering performance metric of a steering system of the motor grader, and at least one moldboard performance metric of a moldboard system of the motor grader;

receiving, with the computing system, an input indicative of a ground speed of the motor grader;

controlling, with the computing system, the steering system according to the steering path and the moldboard system according to the moldboard control instructions when the ground speed of the motor grader is within a threshold speed range for the steering path and the moldboard control instructions;

generating, with the computing system, an updated steering path for steering the motor grader and updated moldboard control instructions for actuating the moldboard as the motor grader moves across the worksite based at least in part on the ground speed, the desired final grade, the at least one steering performance metric, and the at least one moldboard performance metric when the ground speed of the motor grader is outside the threshold speed range; and controlling, with the computing system, the steering system according to the updated steering path and the moldboard system according to the updated moldboard control instructions.

2. The method of claim 1, wherein, when the ground speed of the motor grader is outside the threshold speed range, the method further comprises at least one of:

controlling, with the computing system, a user interface to indicate to an operator that the ground speed is outside the threshold speed range; or controlling, with the computing system, a drive system of the motor grader to adjust the ground speed of the motor grader to a speed within the threshold speed range.

3. The method of claim 1, wherein the at least one steering performance metric comprises at least one of a turning radius of the motor grader or an articulation radius of the motor grader, and wherein the at least one moldboard performance metric comprises at least one of a side-shift range of the moldboard, a rotation range of the moldboard, or a lift range of the moldboard.

4. The method of claim 1, further comprising accessing, with the computing system, a location of a moldboard reference point along a length of the moldboard, the length of the moldboard being defined being between a left end of the moldboard and a right end of the moldboard, wherein generating the steering path and the moldboard control instructions comprises generating the steering path and the moldboard control instructions based at least in part on the moldboard reference point, the desired final grade, the at least one steering performance metric, and the at least one moldboard performance metric.

5. The method of claim 1, further comprising:

determining, with the computing system, whether a reference point on the motor grader is offset from the steering path in a first lateral direction;

controlling, with the computing system, the moldboard system to actuate the moldboard such that the moldboard shifts in a second lateral direction opposite the first lateral direction; and controlling, with the computing system, the steering system to move the motor grader such that the reference point on the motor grader moves in the second lateral direction toward the steering path as the moldboard is being actuated in the second lateral direction.

6. The method of claim 5, further comprising controlling, with the computing system, the moldboard system to actuate the moldboard such that the moldboard shifts back in the first lateral direction as a remaining offset between the reference point on the motor grader and the steering path is reduced.

7. The method of claim 5, further comprising controlling, with the computing system, the steering system according to the steering path and the moldboard system according to the moldboard control instructions when the reference point on the motor grader is back on the steering path.

8. The method of claim 1, wherein generating the steering path and the moldboard control instructions comprises generating at least a first steering pass across the worksite, a second steering pass across the worksite, a first moldboard pass associated with the first steering pass, and a second moldboard pass associated with the second steering pass, and wherein, when the first moldboard pass comprises at least one of a wave pattern or an angle that is greater than an angle threshold, portions of the second steering pass at least partially overlap portions of the first steering pass associated with the at least one of the wave pattern or the angle, and portions of the second moldboard pass associated with the portions of the second steering pass are without a wave pattern or angles greater than the angle threshold.

9. A system for automatically guiding a motor grader within a worksite, the system comprising:

a steering system of the motor grader;

a moldboard system of the motor grader, the moldboard system comprising an actuatable moldboard; and a computing system communicatively coupled to the steering system and the moldboard system, the computing system being configured to:

receive a desired final grade for the worksite;

generate a steering path for steering the motor grader across the worksite and a moldboard control instructions for actuating the moldboard as the motor grader moves across the worksite based at least in part on the desired final grade, at least one steering performance metric of the steering system, and at least one moldboard performance metric of the moldboard system;

receive an input indicative of a ground speed of the motor grader;

control the steering system according to the steering path and the moldboard system according to the moldboard control instructions when the ground speed of the motor grader is within a threshold speed range for the steering path and the moldboard control instructions;

generate an updated steering path for steering the motor grader and updated moldboard control instructions for actuating the moldboard as the motor grader moves across the worksite based at least in part on the ground speed, the desired final grade, the at least one steering performance metric, and the at least one moldboard performance metric when the ground speed of the motor grader is outside the threshold speed range; and control the steering system according to the updated steering path and the moldboard system according to the updated moldboard control instructions.

10. The system of claim 9, wherein, when the ground speed of the motor grader is outside the threshold speed range, the computing system is further configured to control at least one of:

a user interface to indicate to an operator that the ground speed is outside the threshold speed range; or a drive system of the motor grader to adjust the ground speed of the motor grader to a speed within the threshold speed range.

11. The system of claim 9, wherein the at least one steering performance metric comprises at least one of a turning radius of the motor grader or an articulation radius of the motor grader, and wherein the at least one moldboard performance metric comprises at least one of a side-shift range of the moldboard, a rotation range of the moldboard, or a lift range of the moldboard.

12. The system of claim 9, wherein the computing system is further configured to access a location of a moldboard reference point along a length of the moldboard, the length of the moldboard being defined being between a left end of the moldboard and a right end of the moldboard, wherein the computing system is configured to generate the steering path and the moldboard control instructions based at least in part on the moldboard reference point, the desired final grade, the at least one steering performance metric, and the at least one moldboard performance metric.

13. The system of claim 9, wherein the computing system is further configured to determine whether a reference point on the motor grader is offset from the steering path in a first lateral direction;

control the moldboard system to actuate the moldboard such that the moldboard shifts in a second lateral direction opposite the first lateral direction; and control the steering system to move the motor grader such that the reference point on motor grader shifts in the second lateral direction toward the steering path as the moldboard is being actuated in the second lateral direction.

14. A method for automatically guiding a motor grader within a worksite, the method comprising:

receiving, with a computing system, a desired final grade for the worksite;

generating, with the computing system, a steering path for steering the motor grader across the worksite and moldboard control instructions for a moldboard system for actuating a moldboard of the motor grader as the motor grader moves across the worksite;

controlling, with the computing system, a steering system according to the steering path and the moldboard system according to the moldboard control instructions;

determining, with the computing system, whether a reference point on the motor grader is offset from the steering path in a first lateral direction;

controlling, with the computing system, the moldboard system to actuate the moldboard such that the moldboard shifts in a second lateral direction opposite the first lateral direction;

controlling, with the computing system, the steering system to move the motor grader such that the reference point on motor grader moves in the second lateral direction toward the steering path as the moldboard is being actuated in the second lateral direction; and controlling, with the computing system, the steering system according to the steering path and the moldboard system according to the moldboard control instructions when the reference point on the motor grader is back on the steering path.

15. The method of claim 14, further comprising controlling, with the computing system, the moldboard system to actuate the moldboard such that the moldboard shifts back in the first lateral direction as a remaining offset between the reference point on the motor grader and the steering path is reduced.

16. A method for automatically guiding a motor grader within a worksite, the method comprising:

receiving, with a computing system, a desired final grade for the worksite;

generating, with the computing system, a steering path for steering the motor grader along a first steering pass and a second steering pass across the worksite and moldboard control instructions for actuating a moldboard of the motor grader along a first moldboard pass associated with the first steering pass and a second moldboard pass associated with the second steering pass as the motor grader moves across the worksite based at least in part on the desired final grade, at least one steering performance metric of a steering system of the motor grader, and at least one moldboard performance metric of a moldboard system of the motor grader, portions of the second steering pass at least partially overlapping portions of the first steering pass associated with at least one of a wave pattern or an angle greater than an angle threshold, and portions of the second moldboard pass associated with the portions of the second steering pass being without a wave pattern or angles greater than the angle threshold;

receiving, with the computing system, an input indicative of a ground speed of the motor grader; and controlling, with the computing system, the steering system according to the steering path and the moldboard system according to the moldboard control instructions when the ground speed of the motor grader is within a threshold speed range for the steering path and the moldboard control instructions.

17. The method of claim 16, wherein the portions of the second moldboard pass have no side-shifts.

18. The method of claim 16, wherein the second steering pass completely overlaps the first steering pass.

* * * * *